US005562209A

United States Patent [19]

Jackson et al.

[11] Patent Number: 5,562,209

[45] Date of Patent: Oct. 8, 1996

[54] HEAT RESISTANT CURLING IRON COOLER

[76] Inventors: Patricia N. Jackson, 4455 Cedar Creek Cove, Memphis, Tenn. 38141; Daniel L. Johnson, 675 Highland Ct., Marietta, Ga. 30068

[21] Appl. No.: 408,549

[22] Filed: Mar. 21, 1995

[51] Int. Cl.[6] ..... A45D 1/00; A45D 6/00

[52] U.S. Cl. ..... 206/349; 206/320; 206/823; 206/524; 219/242; D28/38

[58] Field of Search ..... 206/349, 320, 206/581, 823, 523, 524; 219/222, 225, 242; D28/38

[56] References Cited

U.S. PATENT DOCUMENTS

| | | | |
|---|---|---|---|
| D. 261,317 | 10/1981 | Oberheim et al. | D28/35 |
| D. 269,299 | 6/1983 | Oberheim | D28/35 |
| D. 300,065 | 2/1989 | Zaborowski et al. | D28/35 |
| D. 313,089 | 12/1990 | Schuler | D28/38 |
| D. 350,230 | 9/1994 | O'Brien | D3/205 |
| 1,530,352 | 3/1925 | Cook | 219/225 X |
| 3,534,392 | 10/1970 | Trouilhet | 219/225 |
| 4,210,797 | 6/1980 | Tomaro | 219/225 |
| 4,267,430 | 5/1981 | Downey | 219/222 |
| 4,308,878 | 1/1982 | Silva | 219/242 X |
| 4,570,792 | 2/1986 | Conway | 206/349 |
| 4,836,374 | 6/1989 | Hutchins et al. | 206/373 |
| 5,062,529 | 11/1991 | Blair | 206/349 |
| 5,141,189 | 8/1992 | Andrew | D28/38 X |
| 5,169,102 | 12/1992 | Bracken | 219/242 X |
| 5,203,456 | 4/1993 | Boswell | 206/349 |

*Primary Examiner*—Paul T. Sewell
*Assistant Examiner*—Tara L. Laster

[57] ABSTRACT

A lightweight small personal appliance items for covering, storing and protecting curling irons. The item includes (6) A Foam rubber outer shell, (9) a layer of insulation, (8) a heat resistant inside lining and (7) an elastic security strap. The curling iron cooler is a single part with the elastic security, strap being an attachment.

1 Claim, 2 Drawing Sheets

*TOP VIEW*

TOP VIEW

SECTION 1–1

RIGHT SIDE VIEW

LEFT SIDE VIEW

ISOMETRIC VIEW

HEAT RESISTANT CURLING IRON COOLER

BACKGROUND—FIELD OF INVENTION

Our curling iron cooler relates to thermal cooling devices, specifically for cooling curling irons.

BACKGROUND—DESCRIPTION OF PRIOR ART

Curling iron covers have been designed for decorative purposes, and to fit only a specific curling iron which the cover was sold with.

In the past women traveling with curling irons have been forced to wrap hotel towels or articles of clothing around the hot irons prior to packing them for travel. This sometimes caused other items in the travelers bag to get damaged.

Appliances small and large have always fascinated small children. Often out of curiosity they are burned when trying to handle curling irons.

There are existing inventions for similar products however, the use is very limited. U.S. Pat. No. Des. 313,089 to Schuler (1990) is the invention of a curling iron cover. This cover is for ornamental decorative use only, it does not claim any safety features.

Another invention U.S. Pat. No. Des. 300,065 to Schwabel Corporation (1989) which only serves as an ornamental cover also. This invention like the previous cited one does not claim safety features or provide added ease for travelers.

U.S. Pat. No. Des. 269,299 to (A. G. Braun) 1983 and U.S. Pat. No. Des. 261,317 to (A. G. Braun) 1981 are both for curling irons with a cover. This cover is only applicable for the specific curling iron it is manufactured with. It cannot be used for a wide variety of curling irons manufactured by different companies.

Another invention U.S. Pat. No. Des. 350,230 to O'Brien (1994) does not claim any noted safety features, such as burn protection and shock prevention. Also, the method of construction for this invention is not very durable.

SUMMARY OF THE INVENTION

The curling iron cover will be used to protect the curling iron barrel. In addition to barrel protection, the curling iron cover will provide safety from bums and electrical shock. It will also allow curling irons to be packed or stored immediately following use while it is cooling down. The said item being made of a compressible foam rubber outside shell, similar to a beverage can holder, and will reduce the chance of breakage occurring with other breakable articles being packed with it.

The inside lining of the opening is constructed of a heat resistant material that will facilitate the receiving of a hot curling iron. This material will speed up the cooling down process by absorbing the heat from the curling iron and transferring it to the heat resistant material.

The vented opening in the end of said item will help dissipate the heat from the cover. The said item will be able to accommodate various sizes and models of curling irons.

The heat resistant curling iron cooler is far more valuable than existing covers, since it fits a wide variety of manufacturers curling irons. Other prior art covers listed and patented either fit only one model of curling iron, or are for decorative purposes only. It provides an added level of safety for both children and adults. The variety of colors and designs make them attractive and the size and weight make them handy and convenient.

Accordingly, several Objects and advantages of our curling iron cooler are:

(a) to provide an easy way for travelers to pack hot curling irons immediately after use;

(b) to provide a safety device to deter small children from being burned if they accidentally handle hot curling irons;

(c) to provide a quick and convenient method for storing curling irons immediately following use;

(d) to provide protection from shock if electric curling irons contract water inadvertently while the curling iron cooler is on the curling irons;

(e) to provide a method of expediting the natural cooling process;

(f) to provide protection of the curling iron barrel finish from scratches and minor abrasions;

Further objects and advantages of our curling iron cooler will become apparent from a consideration of the drawings and ensuing description.

BRIEF DESCRIPTION OF THE DRAWINGS

There are two separate pages of drawings labeled sheet 1 and sheet 2. These 2 pages contain a total of 5 figures

REFERENCE NUMERALS IN DRAWINGS

Figure 1:
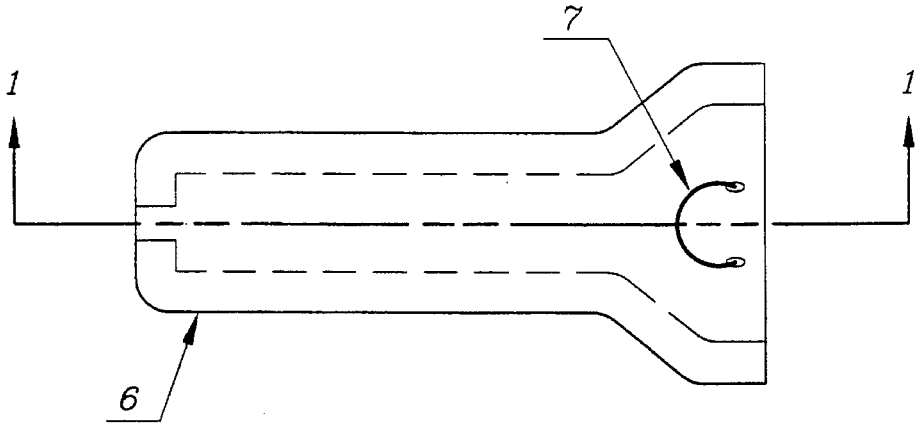
FIG. 1 shows a top section view of the heat resistant curling iron cooler.
Figure 2:
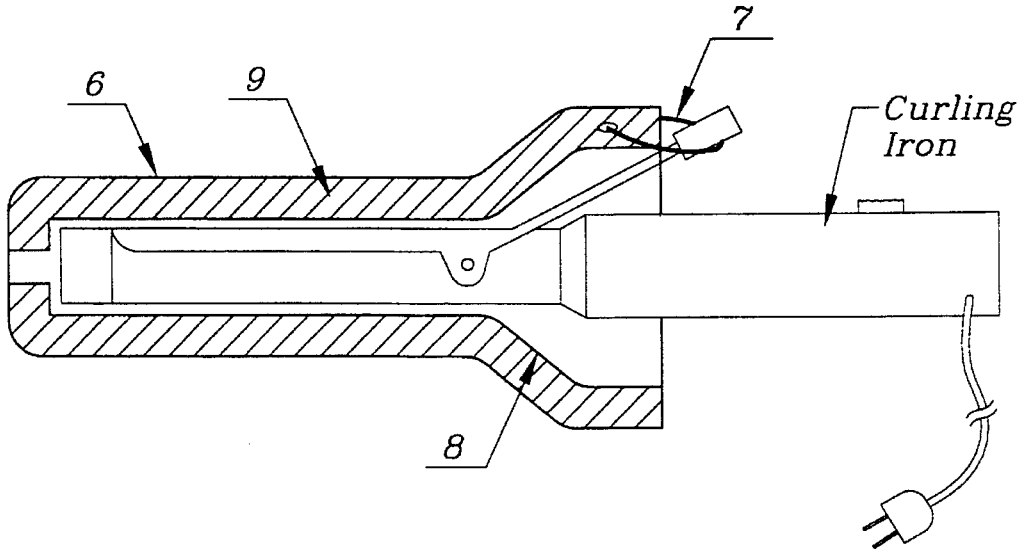
FIG. 2 shows an isometric, 3 dimensional view of the curling iron cooler with security strap.

Please refer to page 1 and FIG. 2.

7 Elastic security strap
6 Foam rubber outer shell
8 Heat resistant inside lining
9 0.953 cm min insulating material.

DESCRIPTION OF THE PREFERRED EMBODIMENTS

A typical view of the entity is shown in a isometric representation in FIG. 2. In this view you're looking at the end that the curling iron is inserted into. The opening is wider on this end which will receive various sizes of barrels that exist today in the market and will easily receive any futuristic larger sizes. The wide funnel type opening covers all metal parts of the curling iron including the spring loaded lever. At the end of all levers is usually a plastic tab the thumb rests on—it is here that the elastic security strap (7) fits over to secure the said item onto the curling iron. Foam rubber outer shell (6) is the entire outside body which is wrapped around no less than 0.0953 cm of insulating material (9). It is ergonomically designed to fit in the palm of the hand tier one hand handling.

The inside lining of the funnel type opening and elongated barrel opening are constructed of a heat resistant material (8) of a nature similar to TEFLON. This material will have a heat resistance factor of approximately 700 degrees. This material will also speed up the cooling down process by absorbing the heat from the curling iron, and transferring it to the heat resistant material. The heat will escape the cover by means of the vented opening on the end and heat will also be dissipated into the atmosphere from the foam rubber curling iron cover. The foam rubber curling iron cover will also guard against possible burns cause by the heat generated by a hot curling iron barrel.

FIG. 2 actually shows how the said item will fit over any curling iron. Once the curling iron is placed through the funnel like end; the elastic security strap (7) is placed over the spring loaded lever. The elongated barrel area is oversized to accept several different sizes and made deep enough such that all curling irons will have min 1.27 cm clearance at the end of said item. It will also be available in various sizes.

Figure 3:
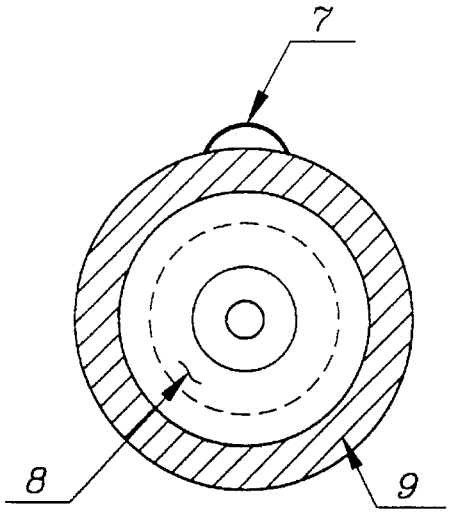
FIG. 3 shows a left side view of the curling iron cooler.

FIG. 3 shows how the curling iron cooler looks from the left hand side, viewed from the end that has a small relief hole which allows air to escape in the event a tight fitting barrel is inserted. This will allow air to escape and the barrel to fit deep inside of the elongated opening. This will also allow air in to help restrict the collection of any moisture that may form from the heat of the barrel of the curling iron.

Figure 4:
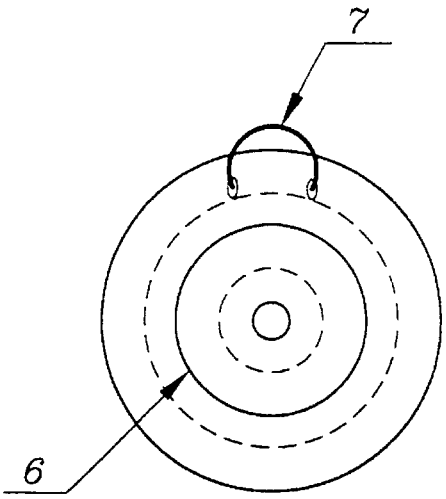
FIG. 4 shows a right side view of the curling iron cooler.

FIG. 4 shows how the curling iron cooler looks from the right hand side, viewed from the funnel like larger opening end where the curling iron is inserted.

Figure 5:
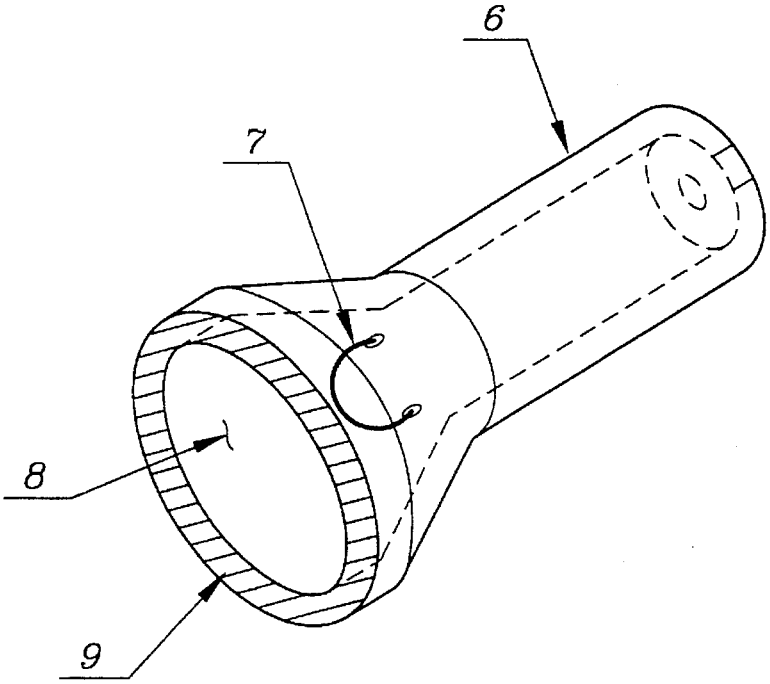
FIG. 5 shows a top view of the curling iron cooler with a security strap.

FIG. 5 shows a top view of how the curling iron cooler will appear.

From the description above, the number of advantages of our heat resistant curling iron cooler become evident:

(a) The curling iron cooler once properly attached helps to provide a safe area of handling if a child should inadvertently pick up a hot curling iron.

(b) Once properly attached onto the curling iron the curling iron cooler will eliminate electrical shock if the barrel accidentally contacts water.

(c) Hot curling iron could be put away immediately after use once the curling iron cooler is attached.

(d) Will keep hot curling irons from damaging neighboring items once the curling iron cooler is attached.

(e) The safety strap (unbroken) keeps the curling iron cooler from accidentally falling off.

(f) Will protect curling iron from scratches and minor dings, once the curling iron cooler is attached.

(g) Our curling iron cooler is designed to take up minimum space and is lightweight in construction.

(h) Our curling iron cooler will be enhanced with the availability of several colors.

Applying the heat resistant curling iron cooler to the curling iron is very simple. The curling iron is inserted into the funnel like wide open end, after it is turned off and disconnected from the power source.

Once inserted into the curling iron cooler, the elastic strap is placed around the spring loaded lever. Our curling iron cooler is now in place. Next the curling iron can be either stored in its proper place or packed away in luggage or overnight bag.

Although the description above contains many specificities, these should not be construed as limiting the scope of the invention but as merely providing illustrations of some of the presently preferred materiality of the invention.

For example, said item can have other shapes such as rectangular, cylindrical, etc.; sizes, colors, designs on outside shell pattern and security strap can be made of any other adjustable material.

Thus the scope of the invention should be determined by the appended claims and their legal equivalents, rather than by the examples given.

We claim:

1. A heat resistant curling iron cover for retaining and cooling a hot curling iron comprising, a cylindrical elongated barrel section for retaining a barrel portion of the curling iron, a truncated conical funnel section attached to said cylindrical section for retaining a spring loaded lever portion of the curling iron, wherein said sections form the cover having an open end for receiving the curling iron and a closed end including a relief hole to facilitate inserting the curling iron into the cover, said cover comprising a foam rubber outside shell, a heat resistant material forming a lining inside said outside shell and being made of a material which is heat resistant to approximately 700 degrees, and an insulation layer disposed therebetween having a thickness of no less than 0.0953 cm, and an elastic security strap attached near the open end of the cover for securing the curling iron within said cover.

* * * * *